United States Patent [19]

Weintraub

[11] 4,095,379

[45] Jun. 20, 1978

[54] MULTI-EXAMINING SPACE ARRANGEMENT FOR A ROTATABLE OPHTHALMIC TABLE OR THE LIKE

[76] Inventor: Joel Weintraub, 40 Arrandale Rd., Rockville Centre, N.Y. 11570

[21] Appl. No.: 706,163

[22] Filed: Jul. 19, 1976

[51] Int. Cl.[2] ..... E04H 3/08; E04B 7/16; A61C 19/02

[52] U.S. Cl. ..... 52/29; 32/22; 312/209; 128/2 R; 52/236.1

[58] Field of Search ..... 312/242, 209, 252; 52/29, 65, 236.1; 32/22; 128/2 R, 2 T

[56] References Cited

U.S. PATENT DOCUMENTS

| | | | |
|---|---|---|---|
| 1,278,108 | 9/1918 | Cimini | 52/29 |
| 2,085,091 | 6/1937 | Fox | 52/65 |
| 3,623,283 | 11/1971 | Abromavage | 52/29 |
| 3,696,805 | 10/1972 | Sweeten | 52/65 |
| 3,911,900 | 10/1975 | Shoen | 52/29 |
| 3,922,788 | 12/1975 | Rota | 312/209 |
| 3,933,400 | 1/1976 | Helgeson | 52/65 |

*Primary Examiner*—John E. Murtagh
*Attorney, Agent, or Firm*—Posnack, Roberts, Cohen & Spiecens

[57] ABSTRACT

An ophthalmic servicing structure comprising a rotatable instrument supporting table disposed within a housing mounted on partitions defining a plurality of rooms, said housing having openings communicating with each of said rooms, whereby said table, upon operative rotation, is accessible to a doctor-patient station in each of said rooms. Adjacent said stations are separate independently manipulable control means operatively connected to table actuating means.

14 Claims, 5 Drawing Figures

MULTI-EXAMINING SPACE ARRANGEMENT FOR A ROTATABLE OPHTHALMIC TABLE OR THE LIKE

FIELD OF THE INVENTION

The invention relates to housings for conventional rotatable ophthalmic tables and the like, and more particularly to arrangements of the type in which a housing is mounted on a wall separating at least two examining rooms in which respective patients are to be examined, whereby the one service table can be used in a multiplicity of rooms.

BACKGROUND OF THE INVENTION

Hitherto, it has been required, for example, of ophthamologists and optometrists to supply each room in which patients are to be examined with a rotatable ophthalmic table which carries thereon those instruments necessary for a proper examination of the patient, along with additional equipment to aid the doctor in his examination. Typically, an optometrist or ophthamologist will have two and sometimes three examining rooms so that, while one patient is being examined, at least one other patient may be prepared for his or her examination in another room. This, of course, imposes a significant financial burden on those desiring to maintain multi-examining space facilities, and involves the need to maintain and repair identical equipment which is prone to damage due to the intricacies and complexities thereof and which remains idle for much of the doctor's working period.

Rotatable ophthalmic tables are well-known in the art, examples of such tables being the Rodenstock Universal Revolving Table, manufactured by G. Rodenstock Instrument of Hamburg, West Germany, and the Octomat 300 revolving table, manufactured by Luneau and Coffingnon of Paris, France.

In the design of each of these known rotatable ophthalmic tables, a plurality of compartments is provided on the table which accommodates therein a plurality of instruments to be used during examination. Typically, four compartments may be provided, with one compartment accommodating a keratometer, another accommodating a slit lamp, another accommodating a phoropter, and another either accommodating another instrument or simply providing a trial lens case or simply a bureau compartment in which the doctor may store items of his choice or which may be used for writing. These prior art compartments, of course, may include different types of instruments, such as a vertex measuring projector, a refracting unit, a focimeter, a fundus camera, a phorovist, and the like, the choice of instruments usually being left to the doctor or user.

SUMMARY OF THE INVENTION

It is a primary object of the present invention to provide an improved arrangement permitting the convenient use of a single service table in a plurality of juxtaposed service spaces.

It is more particularly an object of the invention to provide a means for mounting a conventional rotatable ophthalmic table in a wall separating at least two examining rooms, which arrangement allows for the use of the said rotatable ophthalmic table in these examining rooms.

It is a further object of the invention to provide a symmetrical multi-space arrangement which obviates the need for right and left hand models.

Still another object of the invention is to provide the various advantages thereof in models which enable the user or examiner to sit or stand while using the instruments.

Yet another object of the invention is to provide for the automatic or semi-automatic supply of power in conjunction with operational or preparatory procedures.

Still another object of the invention is to provide an arrangement for selectively covering and exposing a rotatable service table which arrangement is readily installed upon one or more walls.

To achieve the above and other objects of the invention, a service table such as a conventional rotatable ophthalmic table is mounted in a housing, which housing peripherally encompasses the table and may typically be octagonal in shape. This housing is provided with a plurality of hinged doors allowing access to its interior and therefore to compartments and instruments on the table.

The housing is, according to one embodiment of the invention, provided with a pair of diammetrically opposed mounting pieces which support the housing in an opening in a wall separating two rooms in which, for example, different patients can be examined. By virtue of the rotatable mounting of the service or ophthalmic table within the stationary housing, either of the rooms for examining patients may offer access to the instruments provided in the compartments of the table. This is achieved by simply rotating the table until the desired instrument is positioned adjacent the hinged door in the chosen examining room. Thereupon, the particular instrument may be slid out from its compartment in the conventional manner and employed by the user (e.g., doctor).

In another embodiment of the invention, the housing accommodates a conventional ophthalmic table so that access to the instruments on the table can be attained in three examining rooms spaced circumferentially about the ophthalmic table. In this embodiment, the housing is provided with three clamping means for attaching the housing to three walls separating the three examining rooms.

The rotatable ophthalmic table used in the present invention may be of conventional design as explained above. It may be electrically operated so that a pedestal mounting the turntable support can be raised and lowered to a desired height and so that a convenient source of power is provided for the rotation of the table about the pedestal. Further, each of the compartments accommodating an instrument may be typically provided with a sliding carriage for the radial reciprocating movement of the instrument from an inner idle position to an outer operational position.

Upon the movement of such a sliding carriage to its outer operational position, it has heretofore usually been the case that such movement automatically activates a switching relay to provide current to the instrument in order to provide for its utilization. The control panel for the operation of the conventional ophthalmic table has usually been provided adjacent the pedestal, such control panel having controls for the rotation of the table along with controls for local conditions such as room light setting and so forth. Because the control panel has hitherto been mounted adjacent the pedestal, a right-hand version and a left-hand version of the same service or ophthalmic table has been required depending upon whether the user or doctor is right-handed or left-handed. The versions differ only in the positioning of the control panel in order to allow access thereto with either the right or left hand.

The present invention, in addition to possibly employing a conventional control panel, also employs two or more semi-flexible control estensions which provide for the control of the rotation of the table along with the control of the elevated position of the pedestal rod and therefore the table from a remote position. This obviates the need for providing either a left-hand or right-hand version of the ophthalmic table or the like since either version may be employed in the combination of the present invention and still allow operation via the extensions by a right-handed or left-handed person. The extensions are electrically connected to the control panel in a conventional manner and consequently allow for a remote-control capability of the ophthalmic table.

BRIEF DESCRIPTION OF THE DRAWING

The invention will be more readily understood with reference to the following detailed description, when taken in conjunction with the accompanying drawing wherein.

DETAILED DESCRIPTION OF THE INVENTION

Figure 1:
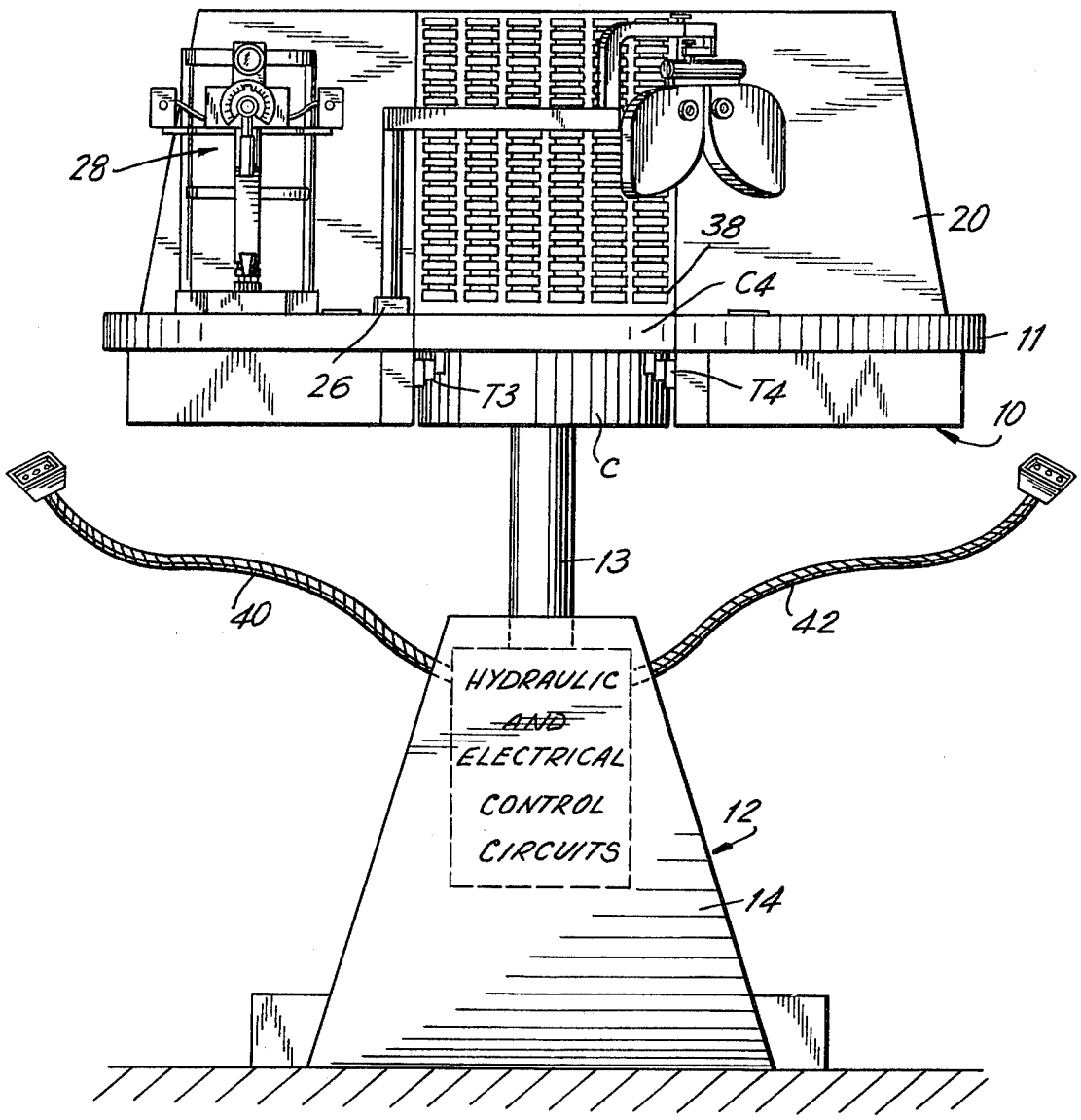
FIG. 1 is a side view showing a conventional rotatable ophthalmic table provided in accordance with the invention, with a pair of control extensions.
Figure 2:
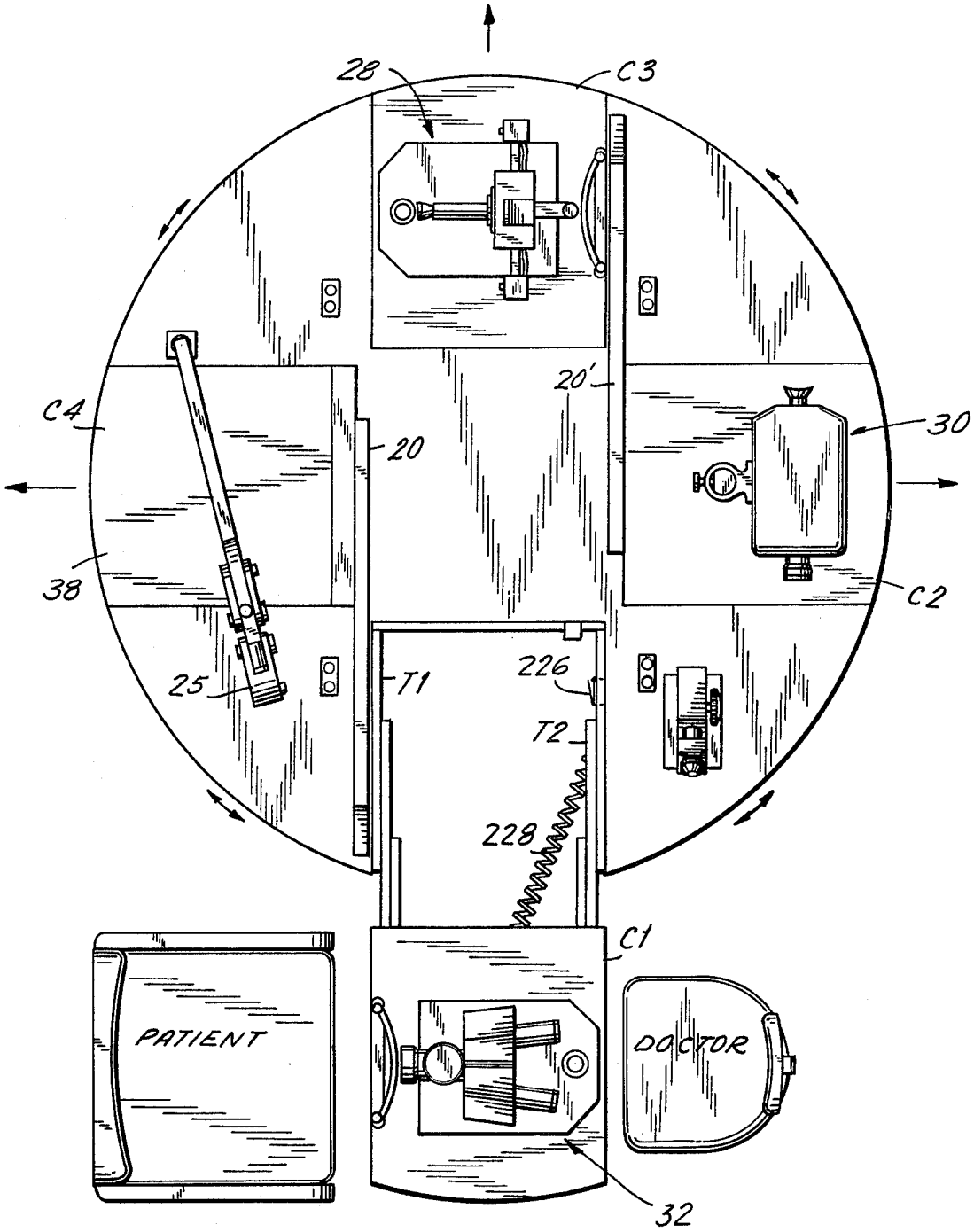
FIG. 2 is a top view of the rotatable ophthalmic table of FIG. 1.

In FIGS. 1 and 2 is shown a conventional rotatable ophthalmic table 10 which includes a turntable support 11 rotatably mounted on a pedestal 12 having an extensible rod 13 which is reciprocable within the housing 14 of the pedestal in order to raise or lower the turntable support 11. The housing 14 houses therein hydraulic and electrical circuitry for controlling the operation of the reciprocable rod 13 and the rotation of the turntable support 11. The hydraulic and electrical circuitry may be of a type which is known in the art.

The turntable support 11 is divided into a plurality of compartments by partitions 20 which are readily removable in order to be repositioned thereby to change the sizes of the compartments, whereby differently sized instruments may be accommodated. In the example of the rotatable ophthalmic table shown in the drawing, there are provided compartments in which are respectively accommodated a phoropter 25 pivotable about a swivel joint 26, a keratometer 28, a fundus camera 30, and a slit lamp 32. In the compartment having the phoropter accommodated therein, there is also provided a lens tray 38.

The lens tray 38, the slit lamp 32, the fundus camera 30, and the keratometer 28 may all be slidable along or parallel to a radius of the turntable support 11. For this purpose, there are provided, for example, carriages C1, C2, C3 and C4. The slit lamp 32 is shown supported on carriage C1 slidable along tracks T1 and T2 (FIG. 2) mounted on the underside of the turntable support 11. Lens tray 38 is illustrated (FIG. 1) as supported on carriage C4 slidable along tracks T3 and T4. Each carriage is extensible to an amount exceeding its length.

Extending from the inside of the housing 14, and in electrical communication therewith, are a pair of semi-flexible extensions 40 and 42, each carrying therein electrical wires for remotely controlling the operation of a motor for the lifting of the pedestal rod 13, and for the control of the rotation of the turntable support 11. The operations for effecting both the rotation of the turntable support 11 and the elevation of the pedestal rod 13 can thus be controlled by the doctor or operator at locations removed from the usual control panels provided on conventional rotatable ophthalmic tables. Furthermore, multiple control locations are provided for use in separate rooms.

Figure 3:
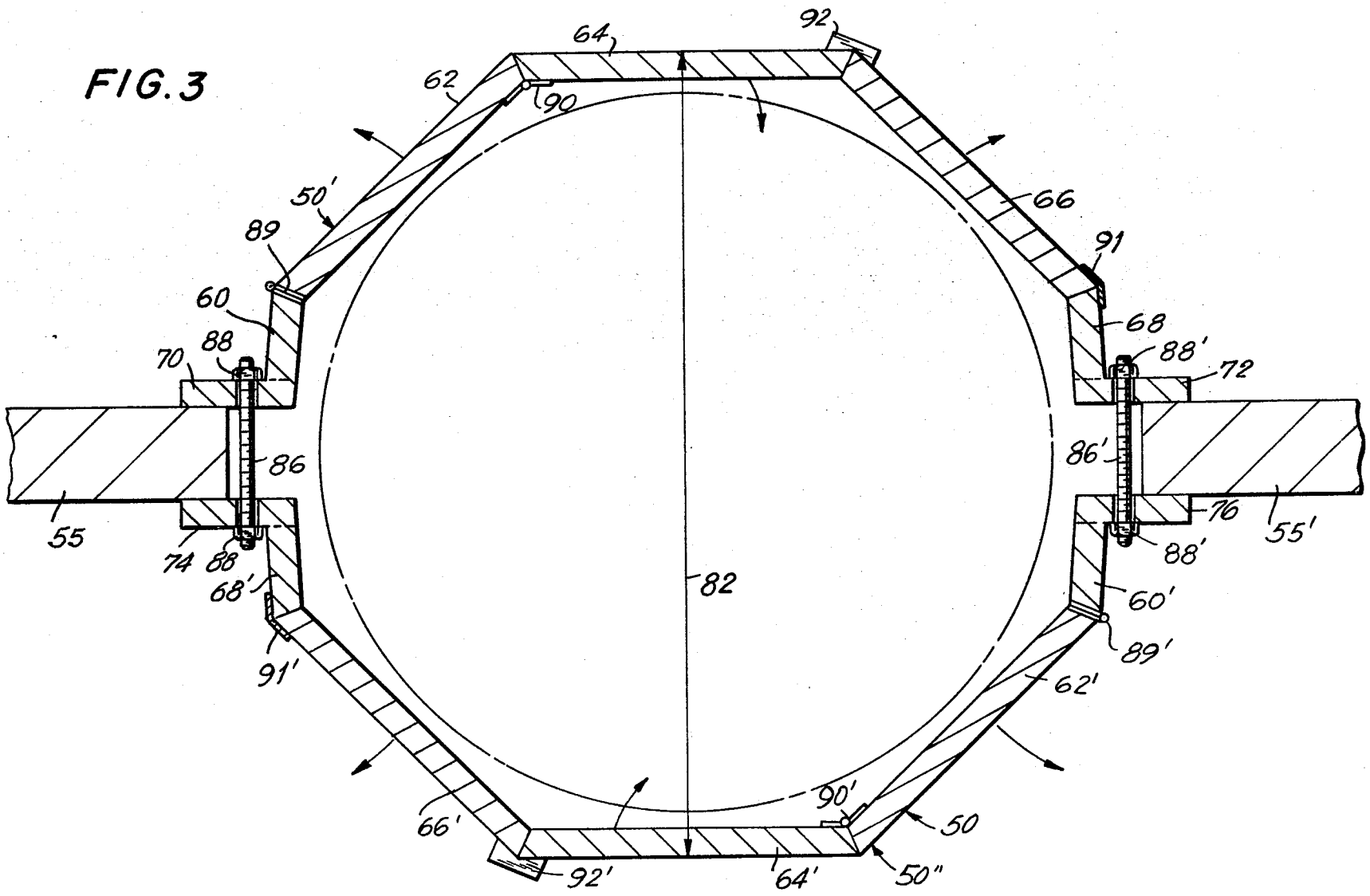
FIG. 3 is a plan view showing the housing of the present invention surrounding and accommodating the rotatable ophthalmic table of FIGS. 1 and 2 in a wall separating two adjoining examining rooms.

FIG. 3 shows a housing for a rotatable ophthalmic table which is provided in accordance with the present invention and which allows the table to be used in two adjoining examining rooms according to the precepts of the invention. More particularly, there is shown a housing 50 (see also FIG. 4) which is comprised of a first half 50′ and an identical second half 50″. Each half is made of a plurality of links or panels 60, 62, 64, 66, 68 or 60′, 62′, 64′, 66′ and 68′. The links 60 and 68 are approximately half the length of the links 62, 64 and 66, and the links 60′ and 68′ are approximately half the length of the links 62′, 64′ and 66′.

Extending from the ends of the half links 60, 60′, 68 and 68′ are four clamping flanges 70, 72, 74 and 76. The clamping flanges 70 and 74 constitute one clamp while the other clamping flanges 72, 76 constitute another clamp for mounting the housing halves on the end portions 55 and 55′ of an opening formed in a wall 56 separating two adjoining examining rooms. As can also be seen in FIG. 3, when the halves 50′ and 50″ are mounted on the wall 56, a housing of octagonal shape is formed. It is to be understood, however, that while an octagonal housing configuration is preferred, a different configuration may also be employed within the purview of the instant invention.

Figure 4:
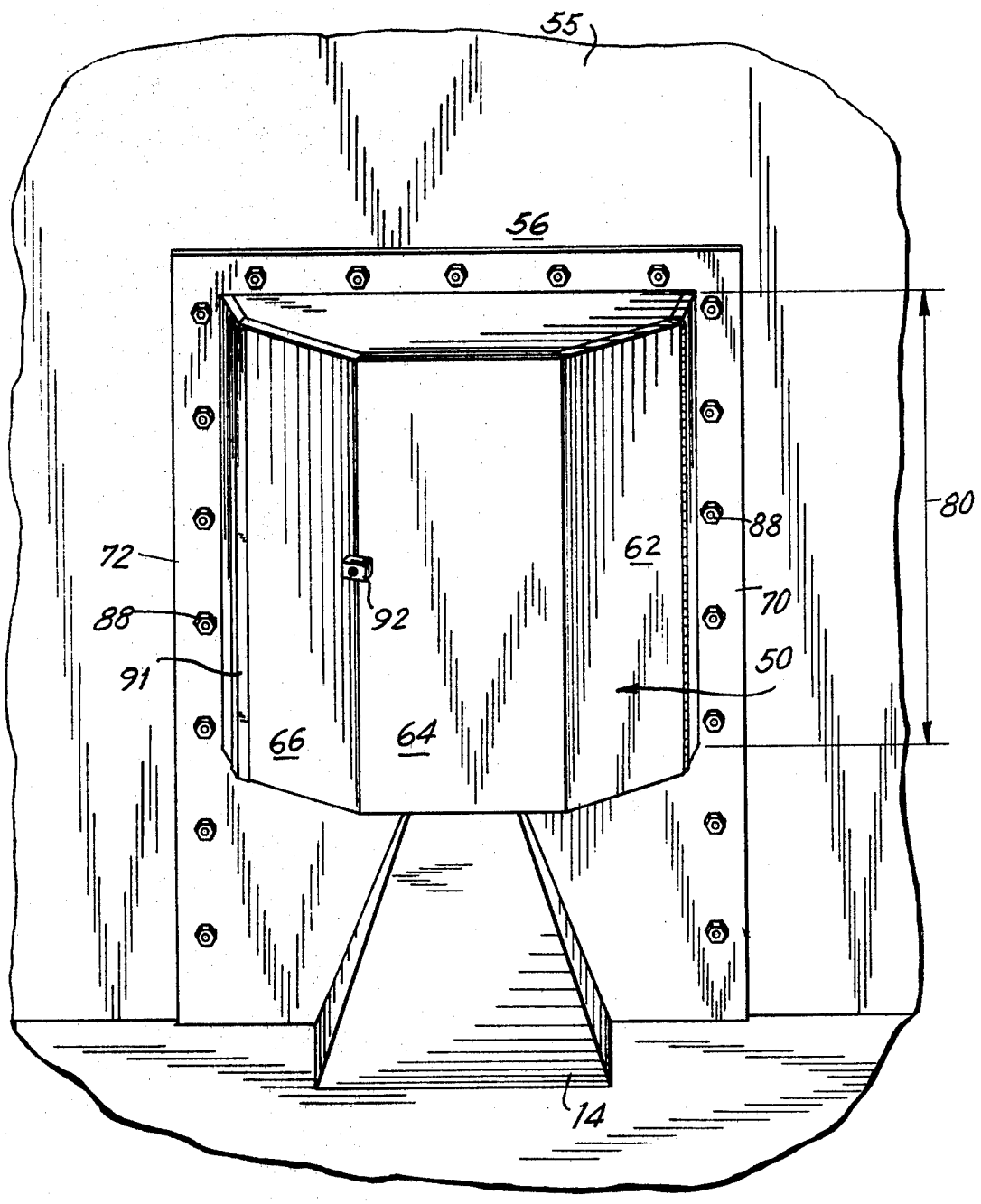
FIG. 4 is a side view showing the housing of the present invention and the pedestal of a conventional rotatable ophthalmic table mounted in an opening formed in the wall separating two adjoining examining rooms as in FIG. 3.

For mounting the ophthalmic table and the housing therefor in the wall separting the two adjoining examining rooms, an opening is first cut out into the wall. The opening has a shape adapted for accommodating the profile of the housing 50 and the pedestal 14 as shown in FIG. 4. That is, a first opening is formed in the wall which is rectangular in shape and has a height equal to the height of the housing 50, this height being indicated by reference character 80 in FIG. 4. The opening has a width approximately equal to the distance between the outer surfaces of any two diammetrically opposed links, this width being indicated by reference character 82 in FIG. 3. The cut-out in the wall is also provided with a pyramidal-shaped portion to conform to the shape of the pedestal housing 14.

After the above-described opening is formed, the ophthalmic table is positioned in the opening so that one half of the table protrudes from one side of the wall and the other half from the other side of the wall. Thereafter, each of the housing halves 50′ and 50″ is mounted on the wall end portions 55 and 55' by screws or clamping bolts 86 and 86' which extend through flanges 70, 74 and 72, 76 respectively.

Where the elements 86 and 86' are bolts, they are engaged by nuts 88 and 88'. Upon the rotation of the bolts 86 and 86' in proper direction, the housing halves 50' and 50'' are drawn toward each other to sandwich therebetween the wall end portions 55 and 55'.

Access to the interior of the housing 50 and thereby to the instruments mounted on the turntable support 11, is provided by the links 62 and 64 on the half 50' and by the links 62' and 64' on the half 50''. The pairs of links constitute two doors for entry into the interior of the housing. The links 62 and 62' are pivotally mounted by hinges 89 and 89' on the outer surfaces of the ends of the half-links 60 and 60'. The other ends of links 62 and 62' are pivotally connected by hinges 90 and 90' to the inner surfaces of the ends of the links 64 and 64', respectively. The distal ends of the links 64 and 64' are provided on their outer surfaces with locks 92 and 92' so that when the doors are closed, the locks can lock the links 64,66 and 64',66' together in the positions which can be seen in FIG. 3. The links 66,68 and 66',68' are reinforced against separating from each other by braces 91 and 91' connecting the ends of these links in abutting relation as can be seen in FIG. 3.

Operation of the apparatus is as follows:

When, for example, a doctor in one of the rooms on one side of the wall 56 desires the use of the ophthalmic table, he simply elevates the pedestal rod 13 by operating a button on one of the control extensions 40 or 42 until the desired height is attained. The doctor can visually gauge when the desired height is reached by opening one of the respective doors in the halves 50' or 50'' according to the room in which he is located. After the desired height has been reached, he then presses the control button which rotates the turntable support 11 until the desired instrument or compartment is located laterally adjacent the door. The instrument is then slid outwardly through the door via the sliding carriage for subsequent use. In the meantime, a patient in the other room is aesthetically and functionally isolated so that his preparation for examination can be independently organized.

The housing may be made of any suitable material that is long-lasting and which preferably provides adequate sound-proofing. The dimensions of a typical housing may be, for example, 1,320 millimeters in height and approximately 1,430 millimeters in diameter. Such dimensions would provide enough clearance above the partitions 20 so that the instruments mounted in the compartments can be slid through either of the doors.

In a modification of the housing, instead of two halves thereof being used to form the completed housing, three identical portions (or possibly more) may be used so that three rooms spaced about the rotatable ophthalmic table may provide access to the table. In such an embodiment, the housing is provided with flanges similar to the flanges 70, 72, 74, and 76 on each of the three portions, and assembled so that a dodecagon or similarly shaped configuration is formed. Instead of the one wall separating two adjoining rooms as in the first embodiment, three walls would separate three adjoining rooms and would provide for mounting the housing. Each portion of the housing would be attached to two of the walls. Each portion can comprise two full links and two half links with the two full links providing the door to allow entry into the interior of the housing.

While a specific embodiment has been shown and described above, it is to be understood that numerous changes and modifications may be made without departing from the scope and spirit of the invention.

Figure 5:
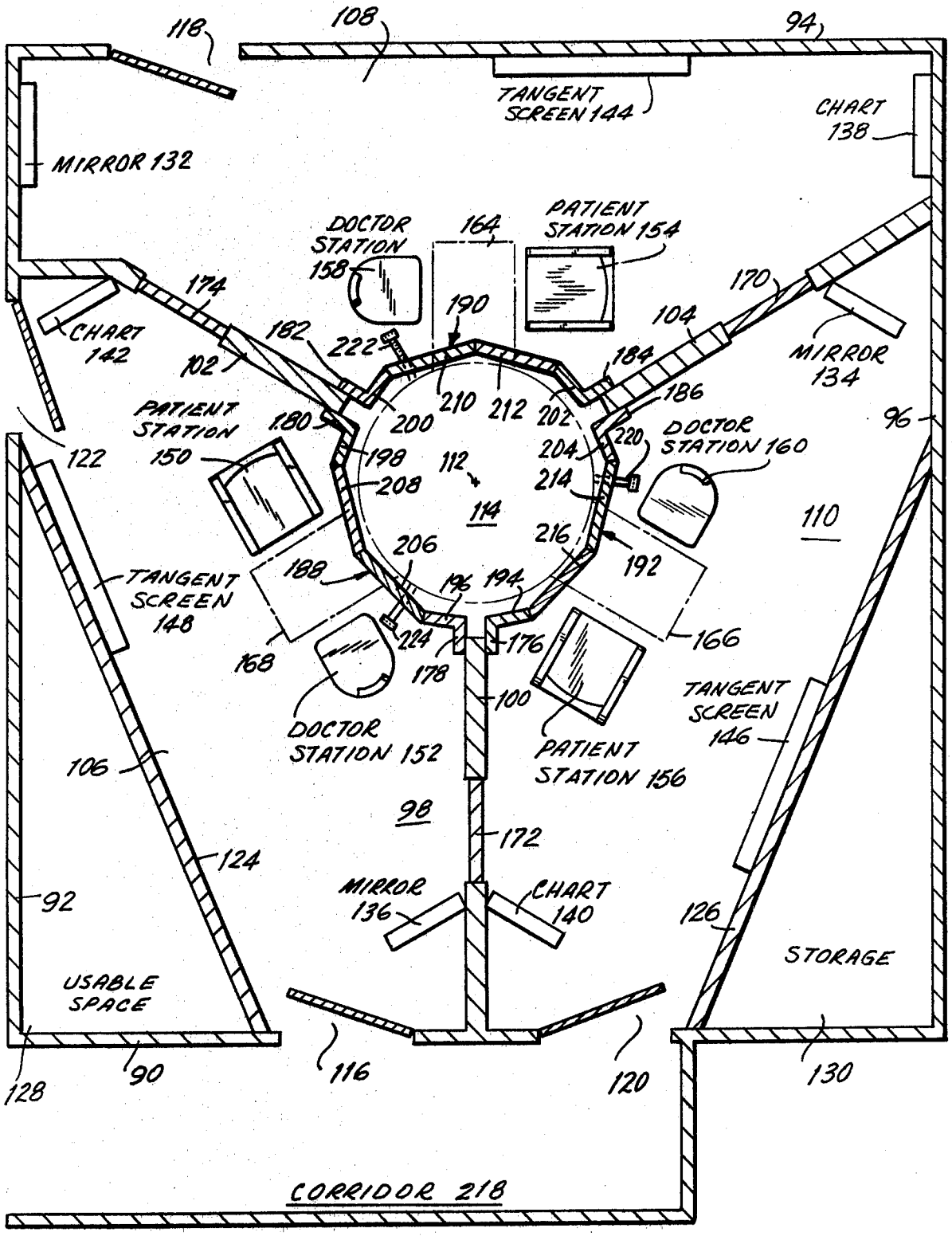
FIG. 5 illustrates a three-room embodiment of the invention.

For example, as shown in FIG. 5, four walls 90, 92, 94 and 96 define a space 98 which three walls 100, 102 and 104 divide into three rooms 106, 108 and 110. These rooms are generally symmetrical about a common axis 112 about which a service table 114 is rotatable.

Access to the rooms 106, 108 and 110 is provided through outer doors 116, 118 and 120. Additional outer doors may be optionally provided such as at 122. Also, the room may be optionally truncated such as by walls 124 and 126 to provide, for example, usable space 128 or storage space 130.

Assuming for purposes of illustration that ophthalmic services are contemplated, there may be appropriately provided mirrors 132, 134 and 136, charts 138, 140 and 142 and tangent screens 144, 146 and 148.

In each of the above-indicated rooms are provided a patient station and a doctor or examiner station constituted generally by suitable chairs commercially available for the purpose. Thus, in room 106 are provided patient station 150 and doctor station 152 while in rooms 108 and 110 are correspondingly provided patient stations 154 and 156 and doctor stations 158 and 160 respectively. These pairs of stations are spaced and permit the intervention therebetween of extensible supports such as diagrammatically indicated at 168, 164 and 166. These supports are extensible and retractable in a radial direction relative to table 114 and are designed as indicated hereinbefore relative to the prior embodiment. The supports are intended to support appropriate instruments thereupon.

The walls 102, 104 and 100 are respectively provided with doors 170, 172 and 174 which permit movement between the rooms. The walls are furthermore engaged by flanges 176, 178 and 180, 182 and 184, 186 in the manner indicated hereinbefore. These flanges extend transversely of end links of housing portions or sections 188, 190 and 192 arranged symmetrically about axis 112. The end links are indicated at 194, 196, 198, 200, 202 and 204 which have lengths or widths which are one-half the lengths or widths of interior links 206, 208, 210, 212, 214 and 216. The interior links are pivotally connected by hinges and appropriately provided with locks as described hereinabove. Extensible supports 164, 166 and 168 extend through the selectively opened interior links which serve as access doors.

There will now be obvious to those skilled in the art many modifications and variations of the structures set forth hereinabove. These modifications and variations will not depart from the scope of the invention if defined by the following claims. For example, access to the structure may be arranged through a corridor 218. Also each doctor's station can be provided with a flexibly mounted remote control 220, 222 or 224 as previously described. Furthermore, the extensible supports can be arranged on tracks to close contacts or operate microswitches to supply electricity to the respective sections (see e.g. microswitch 226 which is coupled to wire 228 which in turn is connected to slit lamp 32 in FIG. 2).

What is claimed is:

1. In combination: at least one wall having an opening, at least two rooms separated by said wall, a rotatable ophthalmic table in said opening, a housing adapted for completely surrounding and protecting said ophthalmic table; said ophthalmic table comprising a pedestal, a pedestal means reciprocable relative to said pedestal between a raised position and a lowered position, a turntable rotatably supported on said pedestal means and a plurality of partitions on said turntable forming a plurality of compartments for the accommodation of a plurality of ophthalmic instruments therein; said housing comprising a first portion and a second portion, each of said portions comprising a plurality of links connectible together, two of said plurality of links of each of said first and second portions being pivotally connected to each other and one of said two links having one end pivotally connected to another of said plurality of links such that said two links serve as a door for allowing access to the ophthalmic instruments mounted on said turntable support within said housing, first means on each of said plurality of links for abutting against sides of said wall adjacent said opening, and second means for holding said first means on said wall, so that said housing accommodates said rotatable ophthalmic table and allows ready access thereto from said rooms.

2. The combination according to claim 1, wherein each of said plurality of links comprises a pair of end links, and wherein said first means comprises a first flange extending transversely from one of said pair of end links, and a second flange extending transversely from the other of said pair of end links, said flanges cooperating to sandwich said wall therebetween.

3. The combination according to claim 2, wherein said second means comprises bolts connecting said flanges.

4. The combination according to claim 1, wherein each said plurality of links comprises five links, two of said links constituting end links of one-half the length of the other links which are positioned therebetween, said half links supporting said first means extending transversely therefrom.

5. The combination according to claim 4, wherein said links cooperatively form an octagonal shape and have a height substantially equal to at least the height of said turntable support inclusive of the height of said partitions, the octagonal shape having an effective diameter adapted to accommodate said turntable support.

6. The combination according to claim 1 for engaging three walls including the first said wall, said three walls being in intersecting relation and separating three rooms including the first said two rooms, said housing further comprising a third portion identical to said first and second portions, third means on said third portion for abutting against a side of two of said walls, and fourth means for holding said third means against the latter said walls.

7. The combination according to claim 6, wherein each of said portions comprises four links, two of said four links being of equal lengths, and the other of said four links being half of said lengths, said housing having a shape of a dodecagon when mounted on the walls separating said three rooms.

8. A servicing structure comprising first means defining a space, second means defining in said space a plurality of rooms disposed about a common axis and provided with a common opening coupling said rooms, a rotatable service table in said common opening and being accessible to each of said rooms; spaced patient and doctor station means in each room, said table including extensible means for extension between the patient and doctor station means in each said room and adapted for supporting instruments thereon, said structure further comprising a housing covering said table and common opening and including doors in said rooms for selectively covering and exposing said table, and means for detachably coupling said housing to said second means.

9. A servicing structure comprising first means defining a space, second means defining in said space a plurality of rooms disposed about a common axis and provided with a common opening coupling said rooms, a rotatable service table in said common opening and being accessible to each of said rooms; spaced patient and doctor station means in each room, said table including extensible means for extension between the patient and doctor station means in each said room and adapted for supporting instruments thereon, said structure further comprising a housing covering said table and common opening and including doors in said rooms for selectively covering and exposing said table, and means for detachably coupling said housing to the second said means, said instruments being ophthalmic instruments, said structure further comprising means for raising and lowering said instruments to adjust the level thereof relative to said stations.

10. A structure as claimed in claim 9 wherein said rooms are arranged in adjacent pairs and said second means includes a wall between each adjacent pair of rooms, said structure further comprising doors in said walls to permit a person's movement between said rooms.

11. A structure as claimed in claim 10 wherein the table is rotatable on said common axis; further comprising actuating means for operatively moving said table, and separate control means adjacent each of said doctor station means and operatively connected to said actuating means.

12. A structure as claimed in claim 9 comprising power means for said instruments actuated by said extension means.

13. A structure as claimed in claim 9 comprising spaced mirror and chart means bracketting each of said patient stations to provide a reflective path of length adequate for eye measurements.

14. The combination according to claim 2 wherein each of said two links has an inner and an outer surface, said two links being pivotally connected together at the inner surfaces thereof, said one of said two links being pivotally connected to said another of said plurality of links at the outer surface thereof, and the other of said at least two links having a lock mounted thereon whereby the door may be locked in place.

* * * * *